US008056377B2

(12) United States Patent
Hacker

(10) Patent No.: US 8,056,377 B2
(45) Date of Patent: Nov. 15, 2011

(54) TETHERED PORTABLE STORAGE DEVICE

(75) Inventor: Dean D. Hacker, Oak Creek, WI (US)

(73) Assignee: Master Lock Company LLC, Oak Creek, WI (US)

( * ) Notice: Subject to any disclaimer, the term of this patent is extended or adjusted under 35 U.S.C. 154(b) by 141 days.

(21) Appl. No.: 12/523,872

(22) PCT Filed: Jan. 26, 2007

(86) PCT No.: PCT/US2007/002144

§ 371 (c)(1),
(2), (4) Date: Dec. 3, 2009

(87) PCT Pub. No.: WO2008/094137

PCT Pub. Date: Aug. 7, 2008

(65) Prior Publication Data

US 2010/0281930 A1 Nov. 11, 2010

(51) Int. Cl.
*B65D 55/14* (2006.01)

(52) U.S. Cl. ..... 70/63; 70/14; 70/18; 70/30; 70/58

(58) Field of Classification Search ..... 70/14, 18, 70/30, 49, 63, 57, 58
See application file for complete search history.

(56) References Cited

U.S. PATENT DOCUMENTS 3,695,067 A * 10/1972 Bays ..... 70/63
3,712,091 A * 1/1973 Parent ..... 70/63
4,325,238 A * 4/1982 Scherbing ..... 70/18
4,573,332 A 3/1986 Ma
4,667,491 A 5/1987 Lokken et al.
4,669,281 A * 6/1987 Young ..... 70/57
5,531,082 A 7/1996 Wolk et al.
5,706,679 A 1/1998 Zane et al.
5,737,947 A * 4/1998 Ling ..... 70/63
6,993,942 B2 2/2006 Boni et al.
6,997,021 B2 2/2006 Boni
D539,540 S 4/2007 Perlman et al.
7,257,972 B2 * 8/2007 Bright ..... 70/58
7,305,858 B1 12/2007 Wu
D569,609 S 5/2008 Hacker
7,870,767 B2 * 1/2011 Brojanac et al. ..... 70/178
7,891,220 B2 * 2/2011 Yen et al. ..... 70/63
2004/0045329 A1 3/2004 Farnham et al.
2007/0180873 A1 8/2007 Yen et al.
2007/0277566 A1 12/2007 Yu

OTHER PUBLICATIONS

International Search Report and Written Opinion from PCT/US2007/02144, mail Oct. 6, 2008.

* cited by examiner

*Primary Examiner* — Suzanne Barrett
(74) *Attorney, Agent, or Firm* — Calfee, Halter & Griswold LLP

(57) ABSTRACT

A portable safe (10) includes a safe body (15) and cover (20) that are selectively coupled with a locking mechanism (32). The safe cover (20) is permanently affixed to a tether (27) having a loop (29) at one end that is sized to allow the safe cover (20) to pass through but does not admit the safe body (15). Thus, the safe cover (20) can be installed on a fixed object by looping the tether (27) around the object, passing the safe cover (20) through the loop (29), and cinching the cover (20) to the fixed object. The safe body (15) can then be locked to the safe cover (20).

18 Claims, 5 Drawing Sheets

TETHERED PORTABLE STORAGE DEVICE

This application is the U.S. national phase entry of PCT/US2007/002144, with an international filing date of Jan. 26, 2007, entitled "Tethered Portable Storage Device", which is incorporated herein by reference in its entirety.

BACKGROUND

It is often desirable to secure one's belongings when traveling away from home to an outdoor or other publicly accessible area. For example, individuals who go to a remote location to participate in an activity such as jogging, hiking, or physical labor may want to secure a small number of personal items such as cash, car keys, and identification or credit cards so that it is not necessary to carry these items during the activity. These personal items may get lost during the activity or may be inconvenient to carry during strenuous activity.

SUMMARY

A portable safe includes first and second safe components. Each safe component partially defines a safe compartment and when the first and second safe components are placed in abutting relationship they form a completely enclosed safe compartment. The first and second safe components are selectively coupled together with a locking mechanism. The first safe component is permanently affixed to a tether having a loop at one end that admits the first safe component, but does not admit the second safe component. Thus, the first safe component can be installed on a fixed object such as, for example, a post, by looping the tether around the object and passing the first safe component through the loop. The second safe component can then be locked to the first safe component.

BRIEF DESCRIPTION OF THE DRAWINGS

In the accompanying drawings, which are incorporated in and constitute a part of this specification, embodiments of the invention are illustrated, which, together with the description of the invention serve to illustrate the principles of this invention. The drawings and detailed description are not intended to and do not limit the scope of the invention or any subsequent claims in any way. Instead, the drawings and description only describe embodiments of the invention and other embodiments of the invention not described are encompassed by this disclosure of the invention.

DESCRIPTION

The Detailed Description of the Invention merely describes preferred embodiments of the invention and is not intended to limit the scope of the claims in any way. Indeed, the invention as described by the claims and specification is broader than and unlimited by the preferred embodiments, and the terms in the claims have their full ordinary meaning.

Travel safes are currently available that are designed to secure valuables such as cash, jewelry, and passports in a hotel room. While effective for their intended purpose, these safes are relatively bulky and most are free standing. These safes discourage theft because they are too large to conceal or too difficult to open. Due to their size, many of these safes are not easily transported from location to location. Because many of these safes are free standing, they are not well suited for use in a publicly accessible or outdoor space, such as a trailhead or worksite, in which the safe would be unattended. A few of these safes are provided with an anchoring device, but these safes are relatively bulky or otherwise unsuitable for installation in an outdoor or public space.

Figure 1:
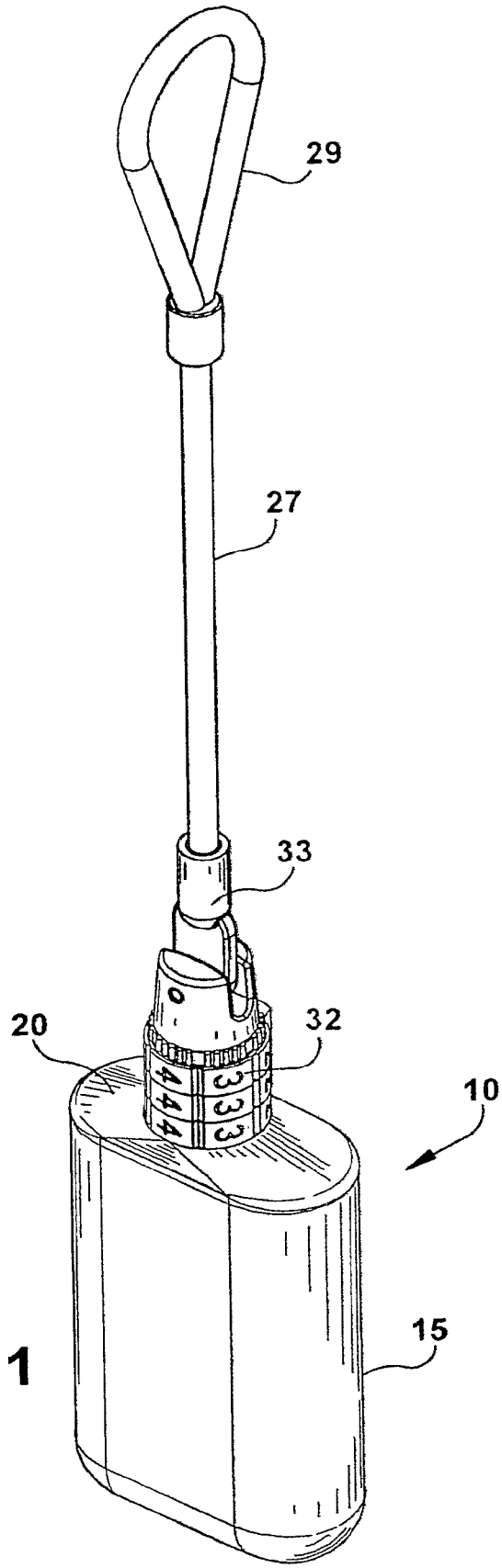
FIG. 1 is a perspective view of a portable safe constructed according to an embodiment of the present invention.

FIGS. 1-6 show a portable safe 10 that can be installed on a stationary object such as a post or door knob. Referring to FIG. 1 in particular, the portable safe 10 includes a safe body 15 and a detachable safe cover 20, both constructed of impact and cut resistant material such as, for example, zinc. The safe cover 20 includes a combination lock 32 with which it is detachably secured to the safe body 15. A flexible tether 27 is permanently affixed to the combination lock 32 and cover 20 with a pivoting cable connector 33. The tether includes, a loop 29 at one end. The loop is sized so that the safe cover 20 can be passed through the loop to cinch the tether to the stationary object. Once the safe cover 20 is installed on a stationary object in this manner, the safe housing 15 may be locked to the safe cover 20 as will be described in more detail below. The loop 29 is sized so that the safe body 15 is prevented from passing through the loop. Because of the relative size between the safe body 15 and the loop 29, once the safe housing is connected to the safe cover the portable safe cannot be removed from the stationary object to which the tether 27 is cinched without severing the tether or separating the safe body from the safe cover.

Figure 3A:
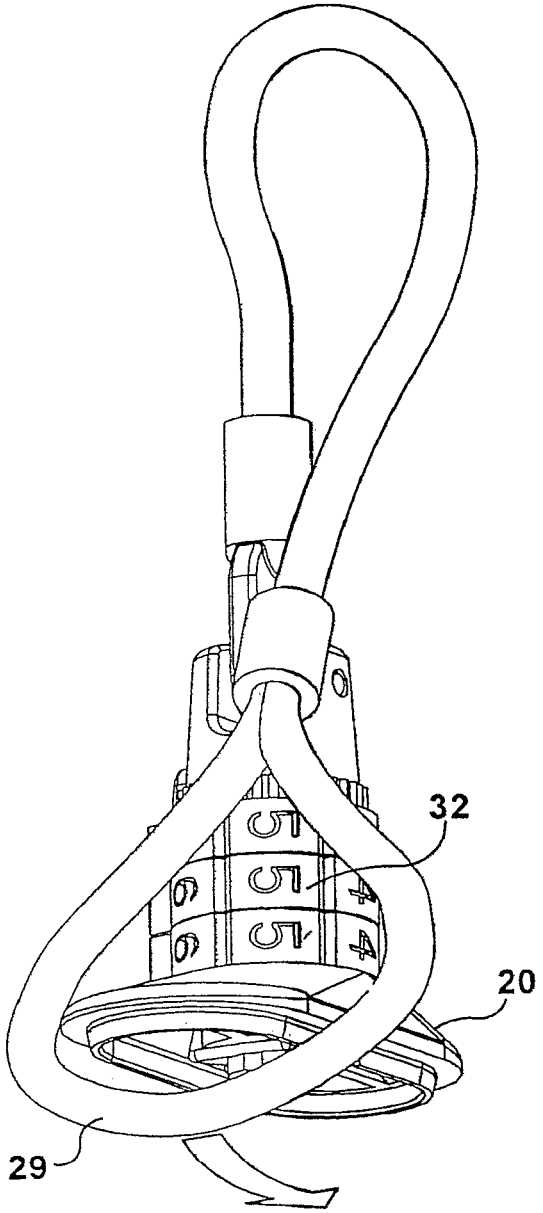
FIGS. 3A, 3B, 4, and 5, are partial exploded views of the portable safe of FIGS. 1.
Figure 3B:
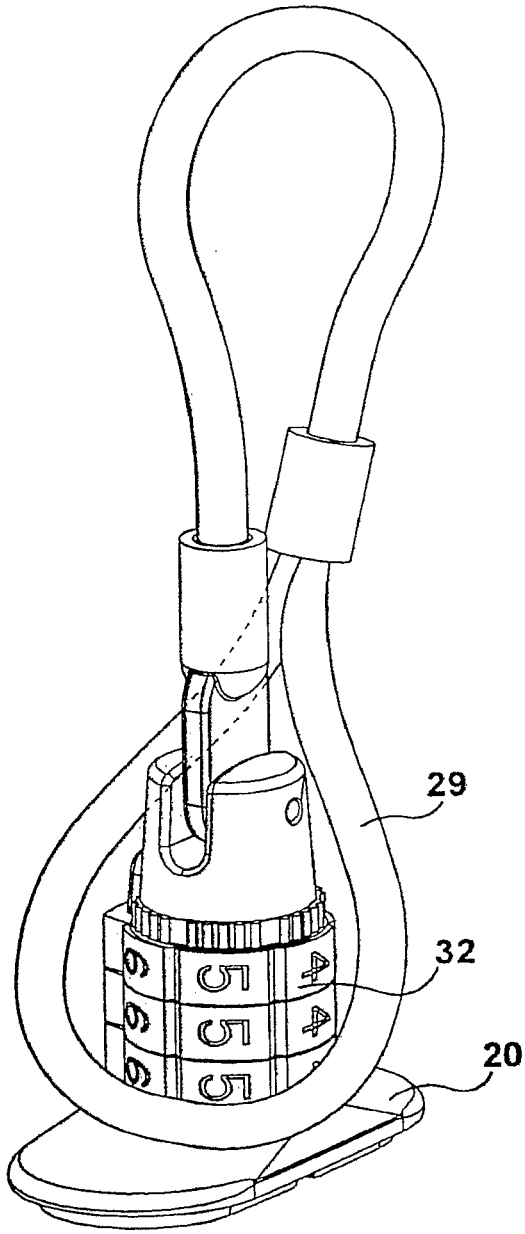

FIGS. 3A and 3B illustrate steps by which the safe cover 20 can be installed by cinching the tether 27 to the stationary object. In FIG. 3A the loop 29 is passed around the safe cover 20 in the direction indicated by the arrow. In FIG. 3B, the tether is cinched about the stationary object (not shown). The safe body 15, shown in FIG. 4 holding a key 50, can now be installed to the safe cover 20 with the combination lock 32 and thereby secured to the stationary object.

Figure 2:
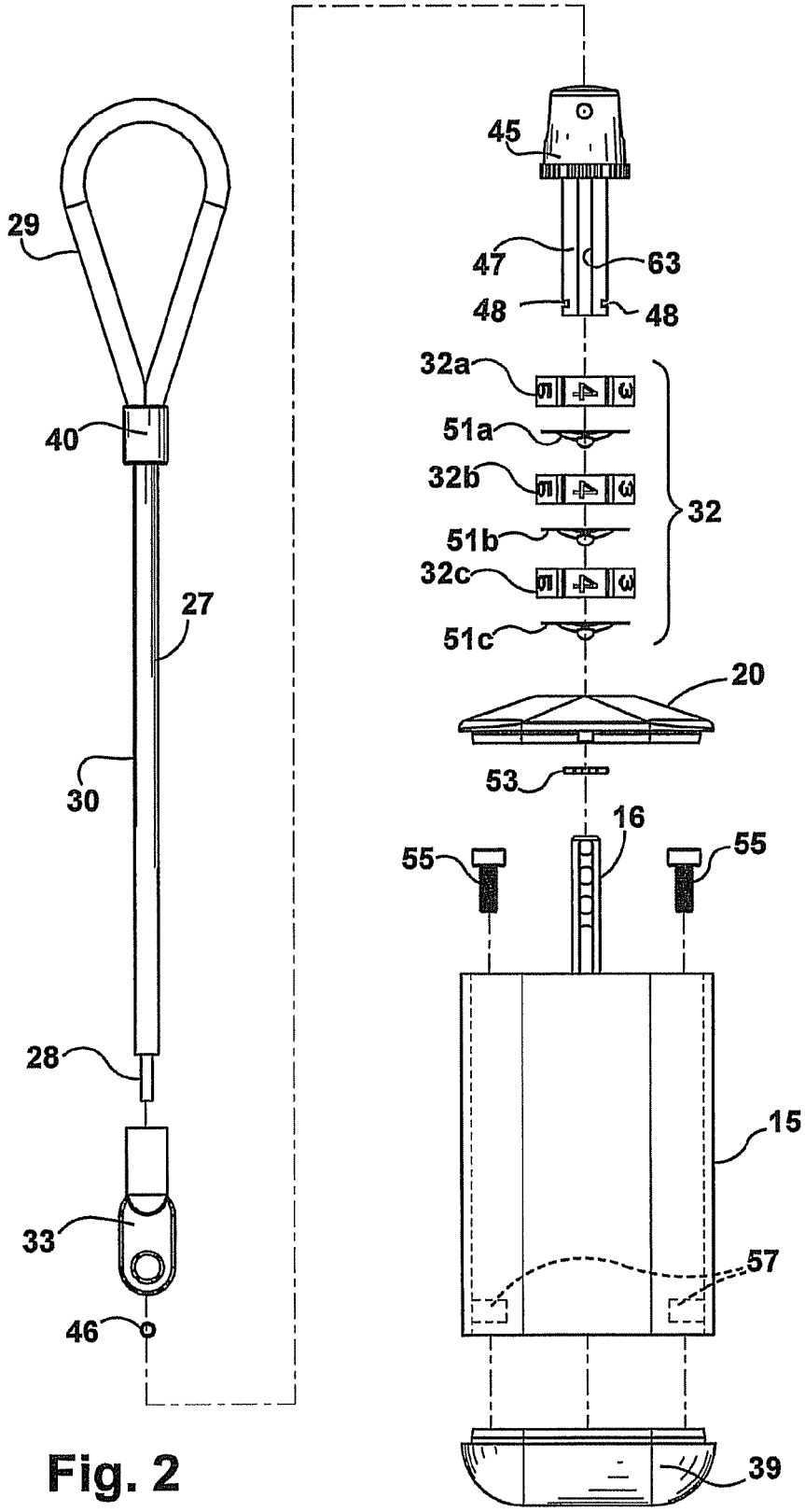
FIG. 2 is an exploded front view of the portable safe of FIG. 1.
Figure 6:
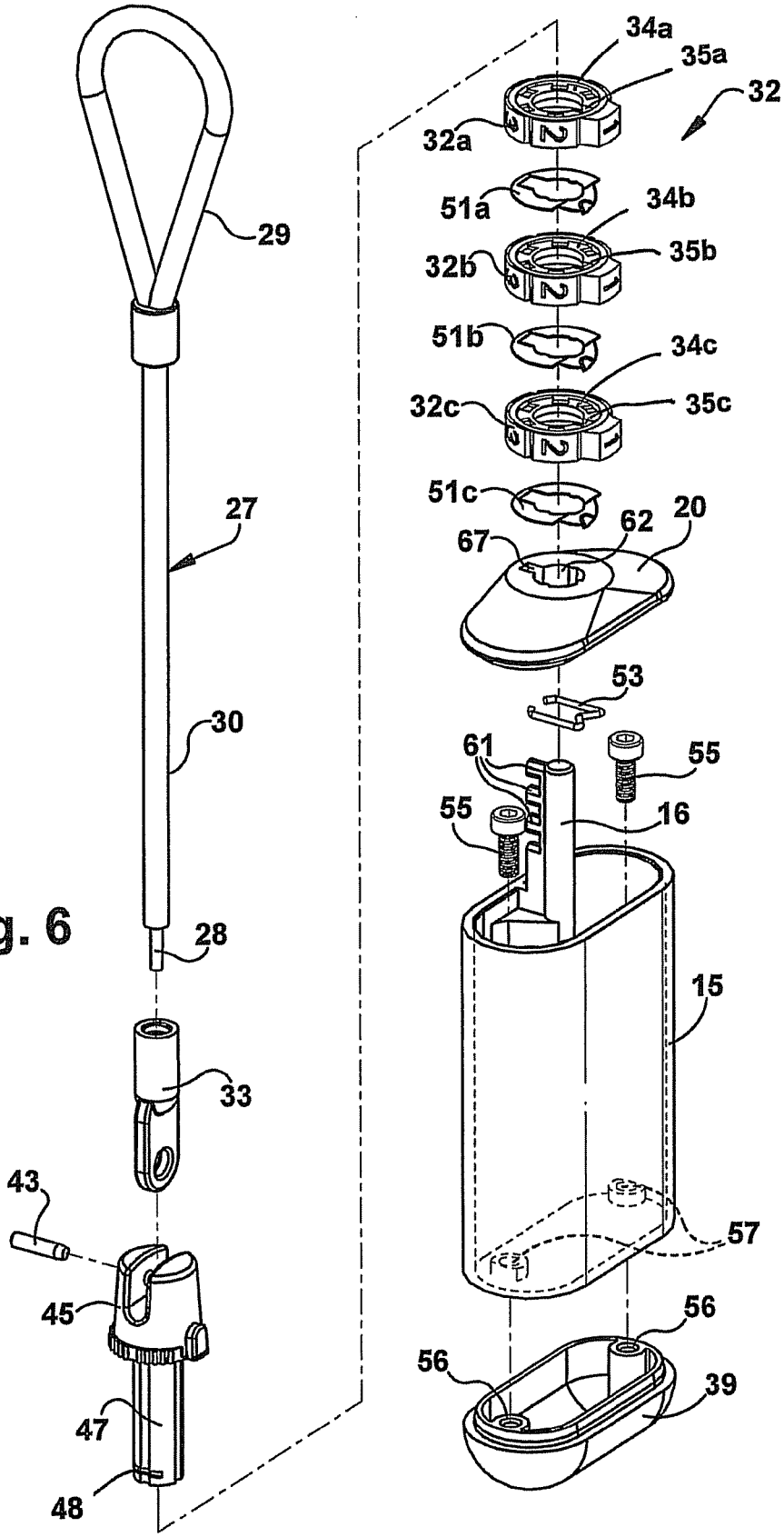
FIG. 6 is an exploded perspective view of the portable safe of FIG. 1.

FIGS. 2 and 6 are exploded views illustrating various components that make up the portable safe 10. The safe cover 20 includes the tether 27 and loop 29, the cable connector 33, and combination lock 32. The tether is made up of a cut resistant flexible cable such as, for example, braided steel filament 28 covered by a protective sheath 30. The protective sheath 30 is made of, for example, vinyl and covers the cable 28 to prevent damage to surfaces that may be caused by contact with the cable. The loop 29 is formed by looping a distal end of the tether and securing the end of the tether to an intermediate portion of the tether by, for example, crimping the end to the tether with a crimp connector 40. The other distal end of the tether is inserted into a cable connector 33 and the clip is crimped or otherwise affixed to the cable 28 and tether cover 30.

Figure 4:
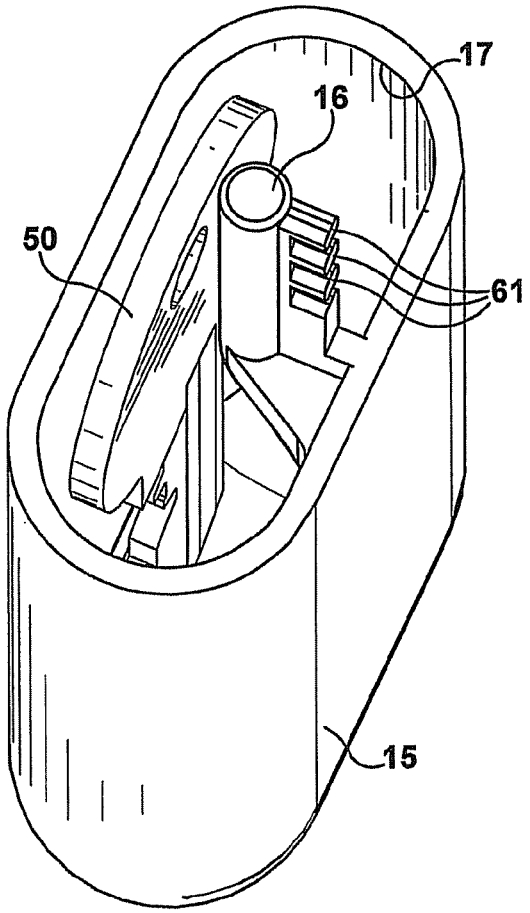

Referring now to FIG. 4, a top perspective view of the safe body 15 is shown as defining sides and bottom of a safe compartment 17. In this particular embodiment the safe compartment 17 is relatively small, for example, sized to accept a house or car key or a credit card sized document. A locking post 16 is integrally formed with the safe body 15. The locking post includes locking pins 61 for locking engagement with the combination lock 32, as described below. As can be seen in FIGS. 2 and 6, the safe body includes a safe bottom 39 that has threaded bosses 56. The safe bottom is attached to the safe body with two screws 55 that are threaded through two integral washers 57 within the safe body and into the threaded bosses 56.

Figure 5:
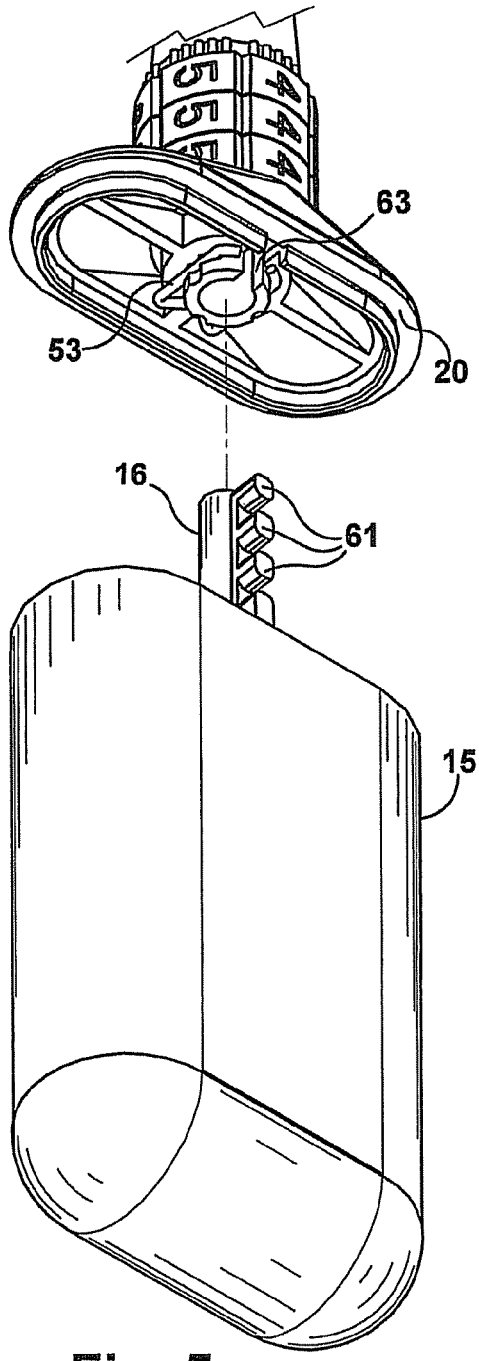

The combination lock 32 is formed by stacking a plurality of lock dials 32*a*-32*c* on a lock cylinder 47 that locates and supports the lock dials in proper alignment for rotation on the lock cylinder. The lock cylinder protrudes from a lock pivot clevis 45 that accepts the cable connector 33 and a pivot pin 43 that pivotally mounts the cable connector to the clevis 45. A slotted detent washer 51*a*-51*c* is associated with each lock dial 32*a*-32*c*. The lock dials each include a plurality of numbers or other such symbols on an outer facing surface, and a retaining flange 34*a*-34*c* on an inner facing surface with a notch 35*a*-35*c* aligned with or keyed to one of the symbols selected to be included in an unlocking combination code. Once the lock dials are stacked on the lock cylinder, the lock cylinder is inserted through a cylinder mounting hole 62 in the safe cover 20, such that a slot 63 in the lock cylinder 47 aligns with a corresponding slot 67 in the safe cover 20. A retaining clip 53 is snap fit around the end of the lock cylinder 47 in grooves 48 to permanently secure the lock cylinder to the safe cover. FIG. 5 shows an underside view of the safe cover 20 and combination lock 32 in which the retaining clip 53 is installed on the end of the lock cylinder to secure the lock cylinder to the safe cover.

To secure the safe cover 20 to the safe housing 15, the lock dials 32*a*-32*c* are rotated to align the notches 35*a*-35*c* with the lock cylinder slot 63 (i.e., in the selected unlocking orientation of the lock dials). The lock cylinder 47 is then slid over the locking post 16, with locking pins 61 aligned with, and extending into, the lock cylinder slot 63 and safe cover slot 67. When one or more of the lock dials are rotated out of the unlocking orientation, the notches 35*a*-35*c* of the one or more lock dials are misaligned with the corresponding locking pins 61, such that the retaining flanges 34*a*-34*c* block withdrawal of the locking pins 61 from the lock cylinder. To remove the safe cover 20 for access to the safe compartment 17, the lock dials 32*a*-32*c* are rotated back to the unlocking orientation, such that the notches 35*a*-35*c* align with the lock pins 61, allowing for withdrawal of the locking post 16 from the lock cylinder 47.

While various aspects of the invention are described and illustrated herein as embodied in combination in the exemplary embodiments, these various aspects may be realized in many alternative embodiments not shown, either individually or in various combinations and sub-combinations thereof. Unless expressly excluded herein all such combinations and sub-combinations are intended to be within the scope of the present invention. Still further, while various alternative embodiments as to the various aspects and features of the invention, such as alternative materials, structures, configurations, methods, devices, and so on may be described herein, such descriptions are not intended to be a complete or exhaustive list of available alternative embodiments, whether presently known or later developed. Those skilled in the art may readily adopt one or more of the aspects, concepts or features of the invention into additional embodiments within the scope of the present invention even if such embodiments are not expressly disclosed herein. Additionally, even though some features, concepts or aspects of the invention may be described herein as being a preferred arrangement or method, such description is not intended to suggest that such feature is required or necessary unless expressly so stated. Still further, exemplary or representative values and ranges may be included to assist in understanding the present invention however; such values and ranges are not to be construed in a limiting sense and are intended to be critical values or ranges only if so expressly stated.

I claim:

1. A portable safe comprising:

a first safe component that partially defines a safe compartment;

a second safe component that partially defines the safe compartment and is detachably secured to the first safe component with a locking mechanism to form a completely enclosed safe compartment, wherein the locking mechanism is a multiple dial combination lock comprising:

a locking post having a plurality of locking pins extending perpendicular thereto; and a locking post receiving cylinder that includes one or more rotating disks each having a plurality of symbols disposed on an outer facing surface and an inner surface having a locking pin retaining flange that includes a notch keyed to one of the plurality of symbols such that when the rotating disks are properly oriented with respect to the locking post, the notches align to form a channel through which the locking post pins may travel;

a tether assembly permanently attached to the first safe component, the tether assembly including a loop at a first distal end of the tether; and wherein the loop defines an inner loop perimeter sized such that the first safe component may be passed through the inner loop perimeter while the second safe component is prevented from passing through the inner loop perimeter.

2. The portable safe of claim 1 wherein the first safe component comprises a safe cover and wherein the second safe component comprises a safe body that defines a majority of the safe compartment.

3. The portable safe of claim 1 wherein the locking post is mounted within the second safe component and the locking post receiving cylinder is connected to a second distal end of the tether.

4. The portable safe of claim 1 wherein the tether is formed from a from braided small gauge filaments of steel.

5. The portable safe of claim 1 wherein the tether is formed from a length of flexible, cut resistant aggregation.

6. The portable safe of claim 1 wherein the tether is formed from a length of cable.

7. The portable safe of claim 2 wherein the safe body is constructed of zinc.

8. The portable safe of claim 1 wherein the first and second safe components are rigid and define a safe compartment that is fixed in size and shape.

9. A method that secures an item comprising:

securing a first safe component to a stationary object by passing the first safe component through a loop located in a tether that is permanently affixed to the first safe component;

placing the item in a safe compartment that is defined by the first safe component and a second safe component, the first and second safe components forming a completely enclosed safe compartment when placed in abutting relationship to one another; and connecting the second safe component to the first safe component with a locking mechanism to form a locked safe compartment.

10. The method of claim 9 wherein the step of connecting the second safe component to the first safe component is performed by inserting a locking post located on the second safe component into a combination lock cylinder that is attached to the first safe component.

11. The method of claim 9 comprising:

disconnecting the second safe compartment from the first safe compartment;

removing the item from the second safe component;

reconnecting the second safe component to the first safe component with the locking mechanism.

12. A portable safe comprising:

a first safe component that partially defines the safe compartment and wherein the first safe component includes a locking post receiving cylinder that includes one or more rotating disks each having a plurality of symbols disposed on an outer facing surface and an inner surface having a locking pin retaining flange that includes a notch keyed to one of the plurality of symbols such that when the rotating disks are properly oriented with respect to one another, the notches align to form a locking pin channel;

a second safe component that partially defines a safe compartment, wherein the second safe component includes a locking post having a plurality of locking pins extending perpendicular thereto; and wherein the first and second safe component form a completely enclosed safe compartment when the locking post is received in the locking post receiving cylinder.

13. The portable safe of claim 12 comprising a tether assembly permanently attached to the first safe component, the tether assembly including a length of cut-resistant, flexible aggregation and a loop at a first distal end of the length of cut-resistant, flexible aggregation.

14. The portable safe of claim 13 wherein the loop defines an inner loop perimeter sized such that the first safe component may be passed through the inner loop perimeter while the second safe component is prevented from passing through the inner loop perimeter.

15. The portable safe of claim 13 wherein the locking post is mounted within the second safe component and the locking post receiving cylinder is connected to a second distal end of the cut-resistant, flexible aggregation.

16. The portable safe of claim 12 wherein the first safe component is a safe cover and wherein the second safe component is a safe body that together define a rigid safe compartment.

17. The portable safe of claim 13 wherein the cut-resistant flexible aggregation comprises a cable formed from braided small gauge filaments of steel.

18. The portable safe of claim 12 wherein the first and second safe components are constructed of zinc.

* * * * *